US007191986B2

(12) United States Patent
Achleitner et al.

(10) Patent No.: US 7,191,986 B2
(45) Date of Patent: Mar. 20, 2007

(54) DEVICE FOR MECHANICALLY AND ELECTRICALLY CHECKING THE SWITCHING DEVICE OF A RAILWAY SWITCH MACHINE

(75) Inventors: Herbert Achleitner, Graz (AT); Anton Schaffer, Zeltweg (AT); Josef Hörtler, Knittelfeld (AT)

(73) Assignees: VAE Eisenbahnsysteme GmbH, Zeltweg (AT); VAE Aktiengesellschaft, Vienna (AT)

( * ) Notice: Subject to any disclaimer, the term of this patent is extended or adjusted under 35 U.S.C. 154(b) by 752 days.

(21) Appl. No.: 10/332,893

(22) PCT Filed: Jul. 12, 2001

(86) PCT No.: PCT/AT01/00230

§ 371 (c)(1),
(2), (4) Date: Jan. 14, 2003

(87) PCT Pub. No.: WO02/06104

PCT Pub. Date: Jan. 24, 2002

(65) Prior Publication Data

US 2004/0069910 A1 Apr. 15, 2004

(30) Foreign Application Priority Data

Jul. 14, 2000 (AT) ..... GM518/2000

(51) Int. Cl.
*B61L 5/00* (2006.01)

(52) U.S. Cl. ..... 246/253; 246/220; 246/449; 246/162

(58) Field of Classification Search ..... 246/253, 246/449, 476, 220, 162
See application file for complete search history.

(56) References Cited

U.S. PATENT DOCUMENTS

| | | | | |
|---|---|---|---|---|
| 2,091,155 | A * | 8/1937 | Merkel | 200/179 |
| 2,740,041 | A * | 3/1956 | Marcum | 246/220 |
| 5,806,809 | A * | 9/1998 | Danner | 246/220 |
| 6,062,514 | A * | 5/2000 | McQuistian | 246/218 |
| 6,296,208 | B1 * | 10/2001 | Franke | 246/220 |
| 6,427,950 | B1 * | 8/2002 | Hoyer et al. | 246/257 |

FOREIGN PATENT DOCUMENTS

| | | |
|---|---|---|
| DE | 1957120 | 5/1971 |

* cited by examiner

*Primary Examiner*—Mark T. Le
(74) *Attorney, Agent, or Firm*—Chapmen and Cutler LLP

(57) ABSTRACT

In a device for checking the operation of devices (4) used to displace movable switch parts (2, 3), in which the movable switch parts (2, 3) are connected with each other by a coupling rod (13), the coupling rod (13) is comprised of two coupling rod parts (14, 15) that are relatively movable in the axial direction. Sensors (34, 35) are provided for the detection of at least two different displacement positions of the coupling rod parts (14, 15).

28 Claims, 4 Drawing Sheets

DEVICE FOR MECHANICALLY AND ELECTRICALLY CHECKING THE SWITCHING DEVICE OF A RAILWAY SWITCH MACHINE

The invention relates to a device for checking the operation of devices used to displace movable switch parts, in which the movable switch parts are connected with each other by a coupling rod.

A device for operating movable switch parts is known, for instance, from AT 405 925 B. In that known device, two relatively axially movable parts are displaceable into a position mutually coupled in a positive and force-transmitting manner in at least one direction of movement, wherein the relatively displaceable parts are comprised of a tube and a rod guided within the tube and are at least partially arranged in a stationary external tube. The locking members used to lock the end positions are formed by balls cooperating with the relatively axially displaceable parts and the external tube, and are displaceable in the radial direction into a locking position in a recess or internal annular groove of the external tube. The rod guided within the tube, at the same time, is designed as a piston rod for a hydraulic cylinder piston unit such that the device known from AT 405 925 B not only ensures the locking of end positions of movable switch parts, but, at the same time, also causes the adjustment of said switch parts. In that known device a rigid coupling rod is additionally provided, via which the switch tongues are connected in a manner that, upon displacement of a tongue, the respectively corresponding movement of the second tongue will be safeguarded in a positive and force-transmitting manner.

Numerous proposals have already become known for checking the correct mode of functioning of such end position locking and adjusting devices. AT 405 925 B, for instance, describes sensors which are arranged adjacent the end side of the hydraulic cylinder piston unit or cylinder, thus signaling the distance of the tubular structural component connected with the tongue from the required end position. A fracture of the coupling rod, for instance, entails the risk of the synchronous movement of the two tongues being no longer safeguarded such that the tongue moving from the closed into the open position will be secured against further displacement, by a separate locking groove, in a position in which the correct end position has not been reached. In that case the sensors will indicate too large a distance of the tongue from the required end position, yet such an operation control entails the drawback that it cannot be taken for sure whether the coupling rod has actually broken or whether a sensor does not function correctly. Another safety device for the monitoring of the switchover movement of movable switch parts is known from WO 97/33784, in which the distance between the stock rail and the closed tongue is detected by inductive sensors in order to check the precise abutment of the tongue.

Bearing in mind the constantly increasing demand made on the control of railway switches and considering the safety rules provided by the railway operators, which become stricter and stricter, the hitherto known safety devices are insufficient, and it is therefore an object of the present invention to provide a device which enables an additional operation checkout of devices used to displace, and lock the end positions of, movable switch parts. The invention, in particular, aims to provide an additional mechanical operation checkout by which any deviation of the tongue position from the respective set position and any operation failure in end position locking can be directly monitored electronically, and the exact cause of trouble can be immediately concluded from the generated signals. To solve this object, the configuration according to the invention essentially consists in that the coupling rod is comprised of two coupling rod parts that are relatively movable in the axial direction, and that sensors are provided for the detection of at least two different displacement positions of the coupling rod parts. Due to the fact that a two-part coupling rod is provided, the two parts of which are relatively movable in the axial direction, the axial length of the coupling rod is changed during the switching procedure of the switch, and it becomes thus feasible to generate during the switching procedure sensor signals which indicate the different displacement positions of the coupling rod parts relative to each other. Consequently, sensors are provided for the detection of at least two different displacement positions of the coupling rod parts. Such a two-part coupling rod is particularly suitable when using switching devices in which the movable switch parts are moved not synchronously, i.e., for instance, via a rigid coupling rod, but in which the open tongue is unlocked first and displaced over a first partial course, whereupon the switching procedure of the closed tongue is only initiated. Such a switching device offers the advantage that the respective tongue being in the closed position is kept in that position for an extended period of time, namely even during the beginning of the switching procedure. During the whole switching procedure, the coupling rod parts are, thus, moved in a manner that the coupling rod will at first become longer at the beginning of the switching procedure, will then keep its length and will again reach its original length at the end of the switching procedure. The sensors can thus signal at least three shifting operations during the whole switching procedure so as to ensure a nearly continuous operation checkout of the switching device. In cooperation with further control means, for instance means integrated in the locking device or means directly attached to the rails, a second control level can be realized with the checkout device according to the invention, thus also enabling the assessment of the cause of a possible failure.

A preferred further development of the device according to the invention consists in that the coupling rod parts comprise stops for the delimitation of their relative axial movability. It is thereby ensured that a change in the length of the coupling rod is feasible only within defined limits and that the coupling rod, after having reached the maximum length provided by the stops, will consequently assume the function of a rigid coupling rod, thus providing a synchronous movement of the two movable switch parts over a portion of the displacement path. This has the advantage that the locking of one tongue simultaneously ensures the securement of the second tongue to some extent, even if the locking device for one of the two tongues does no longer function correctly.

In a particularly advantageous manner, one coupling rod part comprises a tubular part encompassing at least one axial partial region of the other coupling rod part. Such a configuration enables the coaxial arrangement of said one rod part within the tubular part of the other coupling rod part in a manner that, in the main, an encapsulated, outwardly closed device is produced, within which also the sensors and other components can be arranged so as to be protected from external influences.

In a particularly simple manner, the tubular part of one coupling rod part comprises a stop engaging a piston-shaped end piece of the other coupling rod part from behind. Thus, an exact stop is defined in a simple manner, which defines the maximum length of the coupling rod.

In an advantageous manner, the coupling rod parts are interconnected via a spring and, in particular, a helical spring. Such a configuration offers the advantage that the mutual displacement of the two coupling rod parts relative to each other will not be impeded, but that the coupling rod will be retained in its starting position in the event of a possible fracture of the coupling rod, i.e., if the two tongues are no longer rigidly connected with each other. The spring keeps the two coupling rod parts in a defined position relative to each other, in which the two coupling rod parts cannot be relatively displaced due to the action of the spring such that the sensors will not be able to generate switching signals. In this manner, a fracture of the coupling rod will be safely recognized even in a monitoring station locally remote from the switching device.

In a particularly simple manner, the sensors are designed as contact switches such that the reliability of such sensors can be further increased and an appropriate signal will be reliably generated only if the respective end position has been reached. In a preferred manner, a first sensor is rigidly connected with a coupling rod part, which sensor cooperates with an actuation member arranged on the tubular part in order to detect a first displacement end position of the coupling rod parts. This sensor is thus arranged in a manner so as to be displaceable together with one coupling rod part relative to the other coupling rod part and, after having reached a displacement end position, i.e., during the cooperation of the stops for delimiting the change in length of the coupling rod, cooperate with a rigid actuation member arranged on the tubular part, thus generating a signal. It is, furthermore, preferred that a second sensor is rigidly connected with a coupling rod part, which second sensor cooperates with a stop surface provided within the tubular part, in order to detect a second displacement end position of the coupling rod parts, wherein the stop surface, furthermore, may be mounted within the tubular part so as to be resiliently displaceable relative to the same. Such a resilient mounting of the stop surface for the second sensor, which signals the displacement end position that corresponds to the abutment of the tongues, has the advantage that an elastic spring deflection of the closed tongue, which can, for instance, be caused by an overrunning train, will not trigger a switching signal, since the resiliently mounted stop surface follows this resilient movement of the tongue.

In a particularly advantageous manner, the configuration is devised such that the stops are arranged in a displaceable manner. This enables the delimitation of the change in length of the piston rod defined by the stops to be adjusted in a manner that the checking device can be adapted to the respective conditions provided by the switching and locking device. To this end, the piston-shaped end piece advantageously is connected with a coupling rod part via a thread, wherein also the tubular part may be connected with a coupling rod part via a thread.

In order to enable the central monitoring of the switch lock as well as the correct operation of the railway switch, the sensors are advantageously connected with an evaluation and monitoring device. To such an evaluation and monitoring device also the signals of other sensors can be fed so as to enable a detailed failure analysis.

In the following, the invention will be explained in more detail by way of exemplary embodiments schematically illustrated in the drawing. Therein, FIG. 1 illustrates a switch operating device including a coupling rod;

Figure 1:
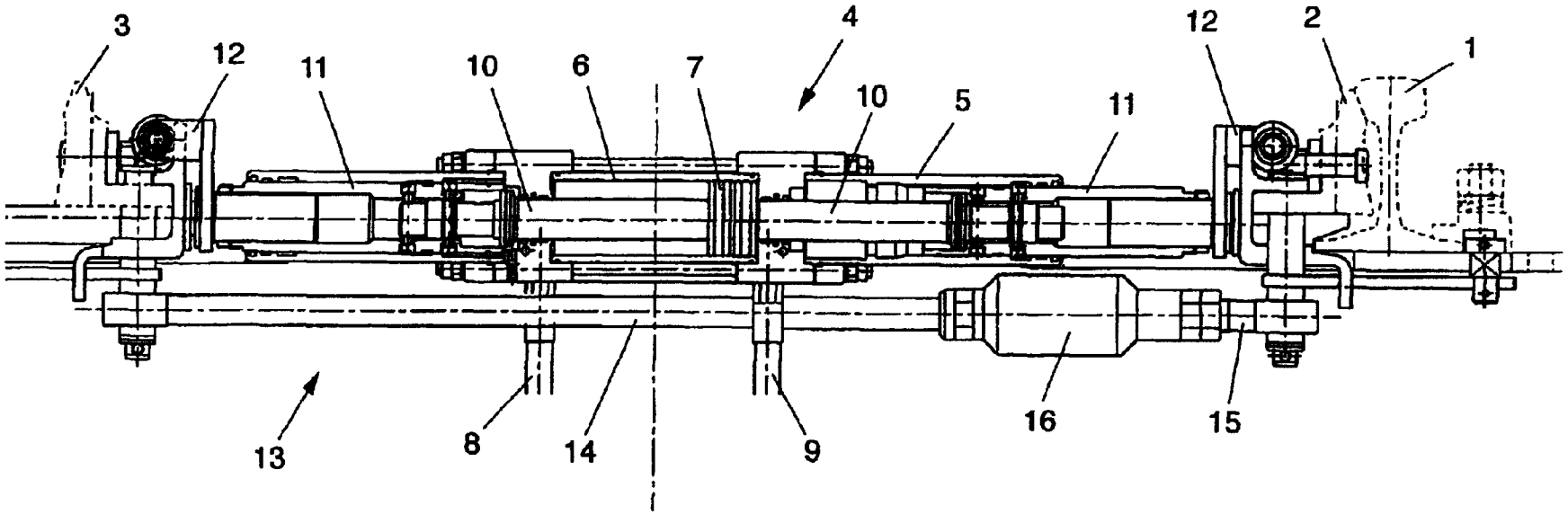
Figure 4:
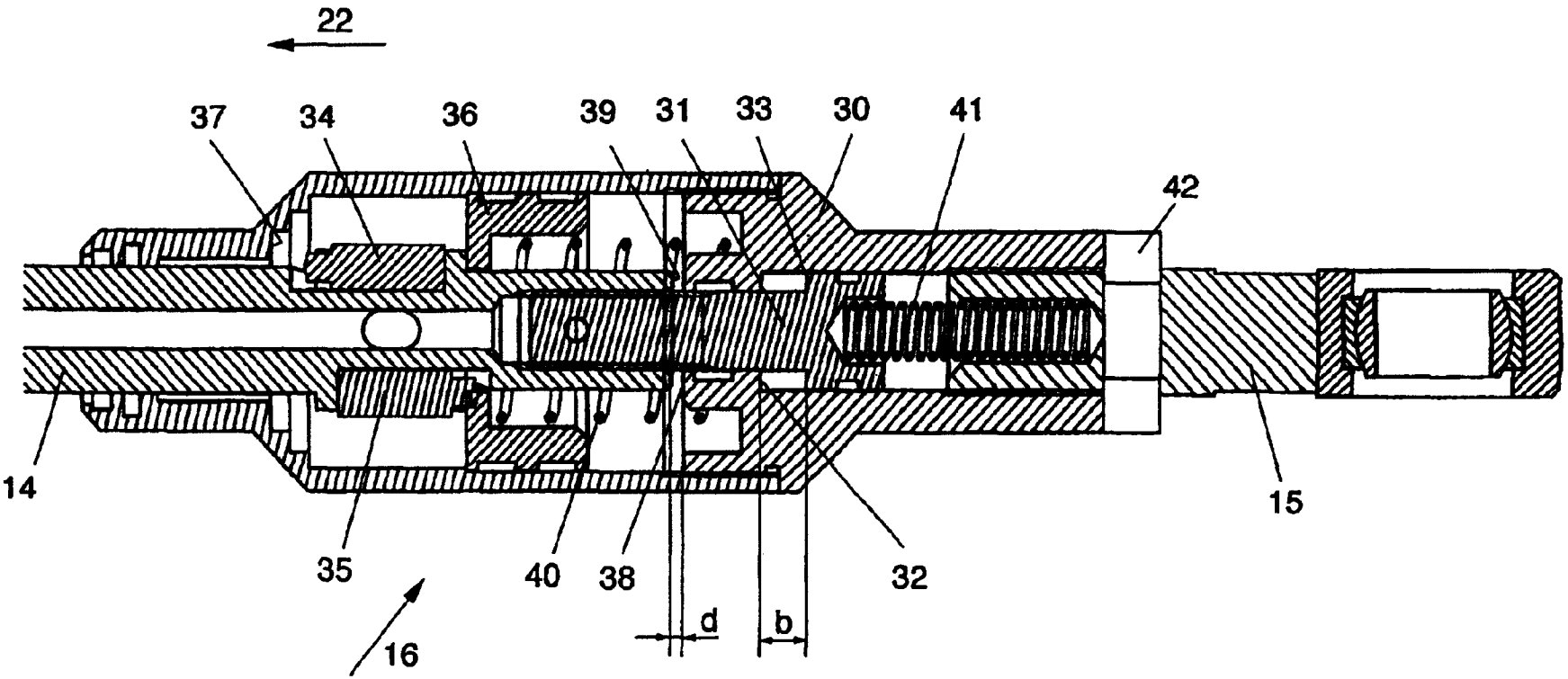
FIG. 4 is a partial illustration of the coupling rod in section.

FIG. 1 depicts a stock rail 1 and a switch tongue bearing against the stock rail 1, which is denoted by 2. The open switch tongue is denoted by 3. Between the switch tongues 2 and 3 is provided a device for displacing and locking the positions of the switch tongues 2 and 3, which is denoted by 4. The switching device 4 comprises an externally arranged tube 5 which extends on both sides of a central portion and is designed as a cylinder 6. A hydraulically movable piston 7 is provided in the interior of the cylinder 6, hydraulic medium being pressed into the respectively active working volumes via hydraulic ducts 8 and 9. The piston 7 is connected with a continuous piston rod 10 having different cross-sectional portions over its axial length. Furthermore, tubes 11 are provided, which are connected with the switch tongues 2 and 3, respectively, via connection means 12. The connection means 12, which are described in detail in WO 99/20511, ensure that vibrations of the switch tongues 2 and 3 will be completely kept away from the switching and locking system 4 while simultaneously enable the play-free absorption of the switching forces. FIG. 1, furthermore, depicts a coupling rod 13 which is comprised of rod parts 14 and 15. Parts 14 and 15 are each coupled to a part of the connection means 12, which part is connected with the switch tongue 2 and 3, respectively. The encapsulated portion 16 of the coupling rod 13 is illustrated in more detail in FIG. 4 and further described below.

Figure 2:
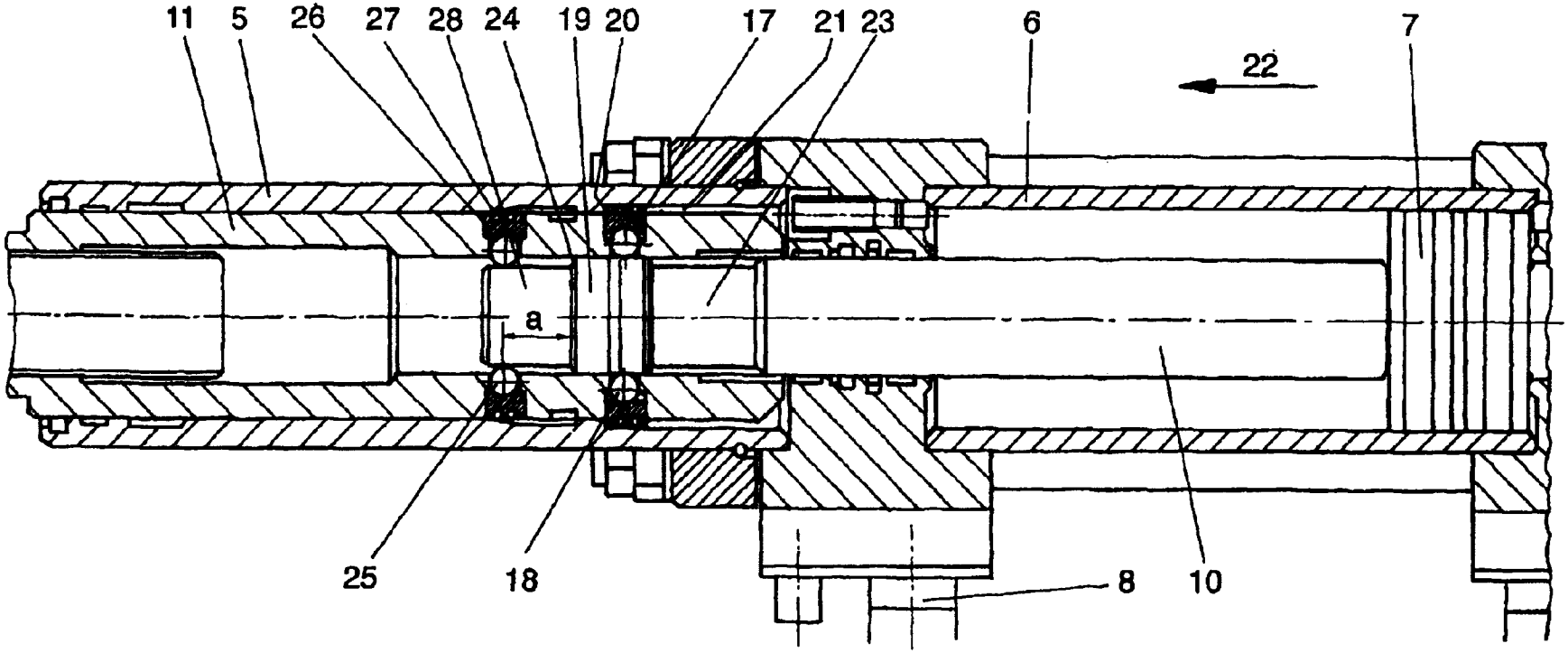
FIG. 2 is an enlarged illustration of the left side of the switching device according to FIG. 1.
Figure 3:
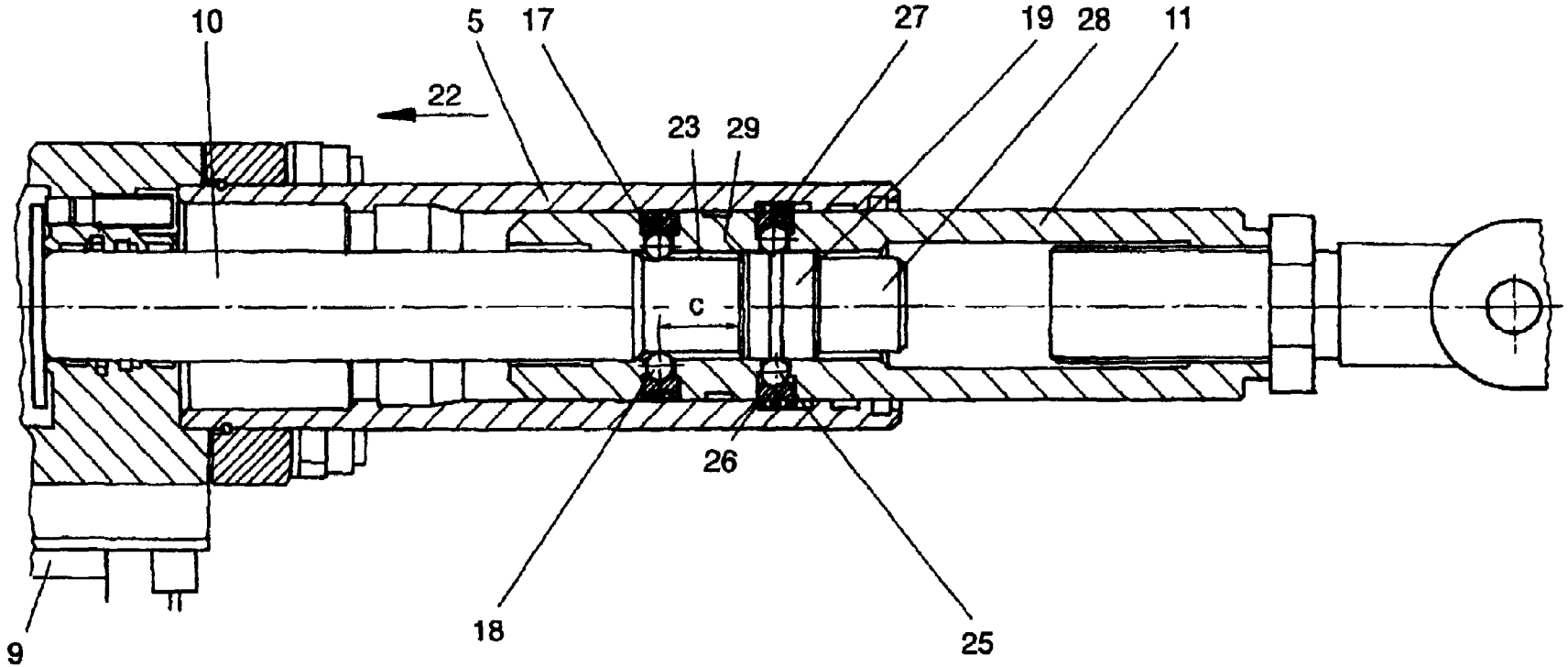
FIG. 3 is an enlarged illustration of the right side of the switching device according to FIG. 1.

From FIGS. 2 and 3, the mode of operation of the switching and locking mechanism is more clearly apparent. The left side of FIG. 1, which is illustrated in FIG. 2, constitutes that side which is responsible for the locking position of the open tongue 3. The locking elements, which are comprised of an expandable ring 17 and the associated balls 18, are kept in the locked position in a recess 21 of the external tube 5 by an axial portion 19 of the piston rod 10 against a stop 20, the stop 20 and the ring 17 thus preventing the tube 11 connected with the tongue 3 from being displaced from the open position of the tongue into a closed position. This locked position for the open tongue 3 can be undone only by displacing the piston rod 10 in the sense of arrow 22 by the aid of the piston 7, thus causing the balls 18 to reach the reduced-diameter axial portion 23 of the piston rod 10. Upon further movement of the piston rod 10 in the sense of arrow 22, a stop shoulder 24 of the larger-diameter portion 19 of the piston rod 10 enters into an active connection with the balls 25 so as to effect an actuation of the switch tongue 3 via the tube 11. At the same time, however, the displacement of the piston rod in the sense of arrow 22 causes the closed tongue 2 to be unlocked, as is illustrated in FIG. 3. The piston rod 10 reaches a position in which the externally located ring 26, which is in the locked position, is able to emerge from its locked position onto the reduced-diameter end portion 28 of the coupling rod 10 under the action of a spring 27 and its associated balls 25, thus enabling a relative displacement of the tubular part 11 relative to the external tube 5. Upon further displacement of the piston rod 10 by feeding fluid to the piston 7 in the sense of arrow 22, the internally arranged stop shoulder 29 of the axial portion 19 designed with a full cross section will, as a rule, not enter into an active connection with the balls 18, since the entrainment of the tongue 2 is effected via the coupling rod 13.

The overlapping lengths of the locking members may, for instance, be chosen such that the active displacement of the open tongue 3 will start after a piston displacement of 14 mm (a) so as to effect the entrainment of the coupling rod part 14 by the open tongue 3. As is more clearly apparent from FIG. 4, the coupling rod part 14 at the beginning of the switching procedure, thus, moves in the sense of arrow 22, whereby the coupling rod part 15, which is connected with the closed tongue 2, remains yet immovable. The coupling rod part 15 is herein connected via a thread with a tubular part 30 encompassing the coupling rod part 14. Connected with the coupling rod part 14 is a piston-shaped end piece 31 which is engaged from behind by a stop 32 of the tubular part 30. Between the stop 33 of the piston-shaped end piece 31 and the stop 32 of the tubular part 30, a distance b is provided at the beginning of the switching procedure. After a piston stroke of, for instance, 12 mm, the piston-shaped end piece 31 comes into abutment on the stop 32 of the tubular part 30 such that the coupling rod part 15 and hence the closed tongue 2 will be entrained. At this point of time, also the lock of the closed tongue 2 has already been undone such that the tongue 2 is displaced via the coupling rod from the closed into the open position. As long as the entrainment of the closed tongue 2 is effected directly by the coupling rod, no active entrainment of the closed tongue 2 will be effected by the piston rod 10, since the balls 18 will not bear against the stop 29 of the piston rod. To this end, the length c must be chosen to be larger than the sum of lengths a and b.

Only as the switch tongue 3 enters into abutment on the stock rail is the entrainment of the switch tongue 2 via the coupling rod stopped such that the balls 18 will bear against the stop 29 and hence cause the active entrainment of the tongue 2 by the piston rod 10. From this point of time, the stop 33 of the piston-shaped end piece 31 moves again away from the stop 32 of the tubular part 30 until the switch tongue 2 is locked via the ring 17 and the locking balls 18. The original distance b will then be again present between the stop 33 and the stop 32 of the piston rod parts.

To the coupling rod part 14 sensors 34 and 35 are rigidly connected, which signal the respective displacement end positions of the coupling rod parts 14 and 15. In the initial position, in which the stops 32 and 33 are kept at a distance b from each other, the contact switch 35 bears against the annular contact part 36. During the switching procedure, the sensor 34 will then contact a counter contact 37 attached to the tubular part 30, whereupon the contact switch 35 triggers a switching signal at the end of the adjustment procedure. During the whole switching procedure, a sequence of switching signals is thus generated, which enables an accurate operation checkout of the switching device.

Between the end face 38 and the end face 39, an axial play d will remain, which can be overcome by the elastic spring deflection or by vibrations of the closed tongue. If the maximum play permissible of the tongue adjusts, this will cause the tubular part 30 to immediately abut on the coupling rod part 14 so as to ensure further locking of the open tongue via the coupling rod. In order not to trigger any switching signals of the sensors 35 during such vibrations or spring deflections of the closed tongue, the annular contact part 36 is resiliently mounted within the tubular part 30 via a spring 40.

A spring 41 is provided between the coupling rod part 15 and the end piece 31 of the other coupling rod part 14. At a break of the coupling rod, the spring 41 causes the distance b between the stops 32 and 33 to be maintained. In this manner, a relative displacement of the coupling rod parts 14 and 15 relative to each other can be avoided so that no signals will be triggered by the contact switches 34 and 25 in that case. On the whole, the two coupling rod parts 14 and 15 are secured via a nut 42.

The invention claim is:

1. A device for checking the operation of devices used to displace movable switch parts, comprising a coupling rod (13) connecting at least two movable switch parts with each other, and coupling the movement of one of the at least two movable switch parts with another one of the at least two movable switch parts, wherein the coupling rod (13) is comprised of two coupling rod parts (14, 15) that are movable relative to each other in the axial direction, said coupling rod parts (14, 15) comprising stops (32, 33) arranged for the delimitation of relative axial movability of the coupling rod parts (14, 15), and wherein sensors (34, 35) are arranged for the detection of at least two different displacement positions of the coupling rod parts (14, 15) relative to each other.

2. A device according to claim 1, wherein the stops (32, 33) are displaceable.

3. A device according to claim 2, wherein one of the coupling rod parts (14, 15) comprises a tubular part (30) encompassing at least one axial partial region of the other one of the coupling rod parts (14, 15).

4. A device according to claim 3, wherein the tubular part (30) is connected to one of the coupling rod parts (14, 15) via a thread.

5. A device according to claim 3, wherein the stops (32, 33) are displaceable.

6. A device according to claim 3, wherein the tubular part (30) of said one of the coupling rod parts (14, 15) comprises one of the stops (32, 33) engaging a piston-shaped end piece (31) of said other one of the coupling rod parts (14, 15) from behind said other one of the coupling rod parts (14, 15).

7. A device according to claim 6, wherein the stops (32, 33) are displaceable.

8. A device according to claim 6, wherein a first one of said sensors (34, 35) is rigidly connected with one of the coupling rod parts (14, 15) and cooperates with an actuation member (37) arranged on the tubular part (30) in order to detect a first displacement end position of the coupling rod parts.

9. A device according to claim 8, wherein a second one of said sensors (34, 35) is rigidly connected with one of the coupling rod parts (14, 15) and cooperates with a stop surface (36) provided within the tubular part (30), in order to detect a second displacement end position of the coupling rod parts (14, 15).

10. A device according to claim 9, wherein the piston-shaped end piece (31) is connected to one of the coupling rod parts (14, 15) via a thread.

11. A device according to claim 8, wherein the piston-shaped end piece (31) is connected to one of the coupling rod parts (14, 15) via a thread.

12. A device according to claim 6, wherein the piston-shaped end piece (31) is connected to one of the coupling rod parts (14, 15) via a thread.

13. A device according to claim 6, wherein the tubular part (30) is connected to one of the coupling rod parts (14, 15) via a thread.

14. A device according to claim 6, wherein the sensors (34, 35) are connected to an evaluation and monitoring device.

15. A device according to claim 3, wherein the sensors (34, 35) are contact switches.

16. A device according to claim 15, wherein a first one of said sensors (34, 25) is rigidly connected with one of the coupling rod parts (14, 15) and cooperates with an actuation member (37) arranged on the tubular part (30) in order to detect a first displacement end position of the coupling rod parts.

17. A device according to claim 3, wherein a first one of said sensors (34, 35) is rigidly connected with one of the coupling rod parts (14, 15) and cooperates with an actuation member (37) arranged on the tubular part (30) in order to detect a first displacement end position of the coupling rod parts.

18. A device according to claim 17, wherein a second one of said sensors (34, 35) is rigidly connected with one of the coupling rod parts (14, 15) and cooperates with a stop surface (36) provided within the tubular part (30), in order to detect a second displacement end position of the coupling rod parts (14, 15).

19. A device according to claim 18, wherein the stop surface (36) is mounted within the tubular part (30) so as to be resiliently displaceable relative to the tubular part (30).

20. A device according to claim 3, wherein the sensors (34, 35) are connected to an evaluation and monitoring device.

21. A device according to claim 2, wherein a tubular part (30) of said one of the coupling rod parts (14, 15) comprises one of the stops (32, 33) engaging a piston-shaped end piece (31) of said other one of the coupling rod parts (14, 15) from behind said other one of the coupling rod part parts (14, 15).

22. A device according to claim 2, wherein the coupling rod parts (14, 15) are interconnected via a spring (41).

23. A device according to claim 3, wherein the coupling rod parts (14, 15) are interconnected via a spring (41).

24. A device according to claim 23, wherein the tubular part (30) is connected to one of the coupling rod parts (14, 15) via a thread.

25. A device according to claim 23 wherein a first one of said sensors (34, 35) is rigidly connected with one of the coupling rod parts (14, 15) and cooperates with an actuation member (37) arranged on the tubular part (30) in order to detect a first displacement end position of the coupling rod parts.

26. A device according to claim 25, wherein a second one of said sensors (34, 35) is rigidly connected with one of the coupling rod parts (14, 15) and cooperates with a stop surface (36) provided within the tubular part (30), in order to detect a second displacement end position of the coupling rod parts (14, 15).

27. A device according to claim 2, wherein the sensors (34, 35) are contact switches.

28. A device according to claim 1, wherein the sensors (34, 35) are connected to an evaluation and monitoring device.

* * * * *